US007059264B1

(12) United States Patent
Hall et al.

(10) Patent No.: US 7,059,264 B1
(45) Date of Patent: Jun. 13, 2006

(54) WATER CRAFT SAFETY SIGNAL SYSTEM

(76) Inventors: Michael W. Hall, 14193 Remington Ct., Fontana, CA (US) 92336; Donna K. Hall, 14193 Remington Ct., Fontana, CA (US) 92336

( * ) Notice: Subject to any disclaimer, the term of this patent is extended or adjusted under 35 U.S.C. 154(b) by 0 days.

(21) Appl. No.: 11/116,545

(22) Filed: Apr. 29, 2005

(51) Int. Cl.
*B63B 17/00* (2006.01)

(52) U.S. Cl. ..... 114/343; 116/173

(58) Field of Classification Search ..... 114/253, 114/343; 116/28 R, 173; 840/984
See application file for complete search history.

(56) References Cited

U.S. PATENT DOCUMENTS 3,117,549 A * 1/1964 Ripepe ..... 116/28 R
D235,094 S 5/1975 Murphy et al
4,099,282 A 7/1978 Townsend
4,483,683 A 11/1984 Alley, Sr.
4,624,141 A 11/1986 Soleau
4,689,611 A 8/1987 Franklin
D296,476 S 6/1988 Kline et al.
4,934,972 A * 6/1990 Shumway et al. ..... 114/253
4,962,720 A * 10/1990 Leffel ..... 116/173
4,977,849 A * 12/1990 Brinton ..... 116/28 R
5,024,179 A * 6/1991 Leffel ..... 116/173

* cited by examiner

*Primary Examiner*—Lars A. Olson
(74) *Attorney, Agent, or Firm*—Donald R. Schoonover

(57) ABSTRACT

A safety system includes a signal flag that is mounted on a water craft and which is connected to a person in a manner such that should the person fall into the water, the signal flag will be automatically and immediately deployed whereby any watercraft in the vicinity will be alerted to the presence of a person in the water.

3 Claims, 3 Drawing Sheets

WATER CRAFT SAFETY SIGNAL SYSTEM

BACKGROUND OF THE INVENTION

1. Field of the Invention

The present invention relates to the general art of water craft, and to the particular field of water craft accessories.

2. Description of the Related Art

Water sports are some of the most popular sports and recreational activities of modern times. On any given day, any body of water has a multitude of water vehicles thereon. People enjoy sailing, boating, fishing, water skiing, and powered water craft use.

As with any popular activity, safety has become a major issue with water activities. People in the water are often at great risk. Unless there is some means for warning nearby water craft of the presence of a person in the water, there can be a dangerous situation.

Therefore, there is a need for a means for warning of the presence of a person in the water.

While the art contains examples of devices to alert a towing vehicle that a towed person has fallen, the inventor is not aware of any device to alert people in other vehicles of the presence of a person in the water.

Therefore, there is a need for a means for warning water craft other than the water craft immediately associated with a downed person of the presence of a person in the water.

PRINCIPAL OBJECTS OF THE INVENTION

It is a main object of the present invention to provide a means for warning of the presence of a person in the water.

It is another object of the present invention to provide a means for warning water craft other than the water craft immediately associated with a downed person of the presence of a person in the water.

SUMMARY OF THE INVENTION

These, and other, objects are achieved by a signal system that is attached to a person and which automatically deploys if the person falls into the water and which will deploy a signal flag that is visible to all water craft in the immediate vicinity of the signaling water craft.

Using the signal system embodying the present invention will permit all water craft in the immediate vicinity to be immediately alerted to the presence of a person in the water.

BRIEF DESCRIPTION OF THE DRAWING FIGURES

DETAILED DESCRIPTION OF THE PREFERRED EMBODIMENT

Figure 2:
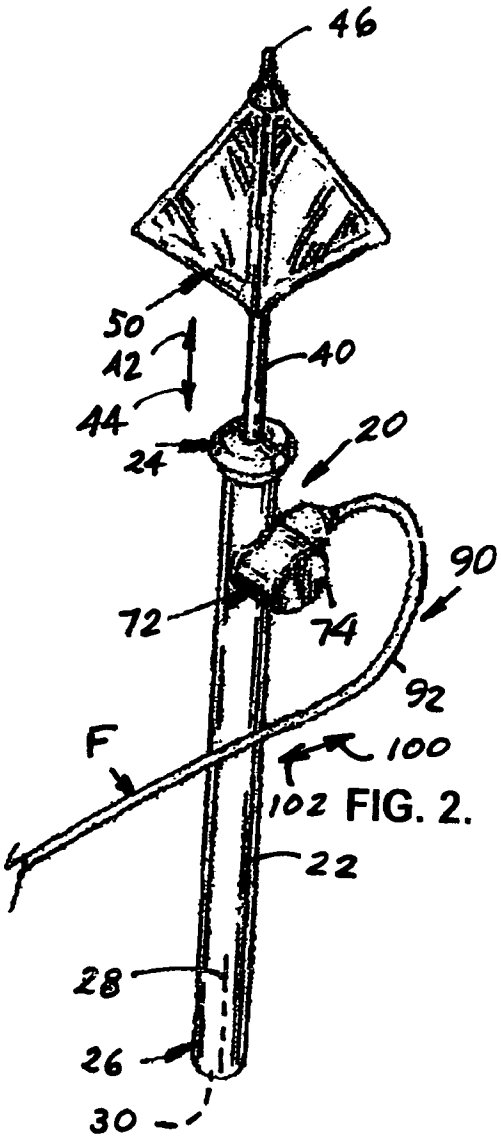
FIG. 2 is a perspective view of a signal flag used in the signal system embodying the present invention.

Other objects, features and advantages of the invention will become apparent from a consideration of the following detailed description and the accompanying drawings.

Referring to the Figures, it can be understood that the present invention is embodied in a water craft safety signal system 10 which achieves the above-stated objectives.

System 10 comprises a mounting element 12 mounted on a water craft 14.

A signal flag unit 20 is mounted in mounting element 12 and includes a tubular housing 22 having a first end 24 which is a top end when signal flag unit 20 is mounted on the water craft 14, a second end 26 which is a bottom end when signal flag unit 20 is mounted on the water craft 14, a longitudinal axis 28 which extends between first end 24 and second end 26, and a longitudinal bore 30 which extends between first end 24 and second end 26.

A support staff 40 is slidingly accommodated in bore 30 of the tubular housing 22 to move toward and away from first end 24 in directions 42 and 44. Support staff 40 has a first end 46 which is a top end when signal flag unit 20 is mounted on the water craft and is positioned outside of bore 30, a second end 48 which is a bottom end when the signal flag unit 20 is mounted on the water craft 14 and which is located inside bore 30. Support staff 40 is movable within tubular housing 22 in directions 42 and 44 to move between a stored position shown in FIG. 4A with first end 46 located near first end 24 of tubular housing 40 and a signaling position shown in FIG. 4B with first end 46 of the support staff 40 spaced away from the stored position in the direction of longitudinal axis 28 of tubular housing 22.

A signal element 50, such as a flag or the like, is fixedly mounted on the support staff 40 near first end 46. A light or beacon can also be used as will be understood from the teaching of the present disclosure.

A spring seat 54 is fixed to second end 48 of the support staff 40.

A spring 60 is located in bore 30 of tubular housing 22 and has a first end 62 engaged with spring seat 54 and a second end 64 engaged with tubular housing 22 as via a cover 66 on the housing 22. Spring 60 is arranged to bias support staff 40 in direction 42 out of bore 30 of the tubular housing 22 toward the signaling position when the support staff 40 is in the stored position.

A signal flag unit control system 70 includes a retainer unit 72 mounted on the tubular housing 22. Retainer unit 72 includes a housing 74 mounted on tubular housing 22 adjacent to first end 24.

A solenoid unit 80 is located in housing 74 and has a solenoid controlled prong 82 that extends into bore 30 of the tubular housing 22 and moves toward and away from spring seat 54 in a direction transverse to longitudinal axis 28 of the tubular housing 22 between a locked position engaging the spring seat 54 and a release position (shown in FIG. 4B) spaced apart from the spring seat 54. The directions of prong movement are indicated by double headed arrow 84 in FIG. 4B. Solenoid unit 80 is located with respect to the spring seat 54 so the prong 82 engages the spring seat 54 when the solenoid unit 80 is in the release position when the support staff 40 is in the stored position thereof to retain the support staff 40 against movement toward the signaling position under the influence of the bias of the spring 60. The solenoid unit 80 has the prong 82 in the locked position when activated and moves the prong 82 to the release position when de-activated. The solenoid unit 80 has a spring 88 which biases the prong 82 outwardly into a spring seat-engaging location and pulls the prong 82 back out of engagement with the spring seat 54 when the solenoid 80 is activated.

A solenoid unit control unit 90 is connected to the solenoid unit 80 to move the prong 82 of the solenoid unit 80 between the locked position and the release position and includes a cord 92. Cord 92 has one end 94 connected to the solenoid and a free end 96.

An ankle strap 98 is located on free end 96 of cord 92. The ankle strap 98 is attached to the leg of a skier or to the leg of a water craft operator.

Cord 92 moves in directions 100 and 102 between a first position and a second position. The solenoid 80 is de-activated when the cord 92 is in the second position. If a person to whom the ankle strap 98 is connected falls overboard or into the water, the cord 92 will move into a position to de-activate the solenoid 80 and cause the prong 82 to move away from the spring seat 54 to free the support staff 40 to move under the influence of the bias of spring 60 in direction 42 into the signaling position.

A manual override system 110 has a manually operated switch 112 connected to the solenoid unit 80 to activate or de-activate the solenoid unit 80 using the manual switch 112 of the manual override system 110. A suitable circuit is shown in FIG. 3A.

Figure 3A:
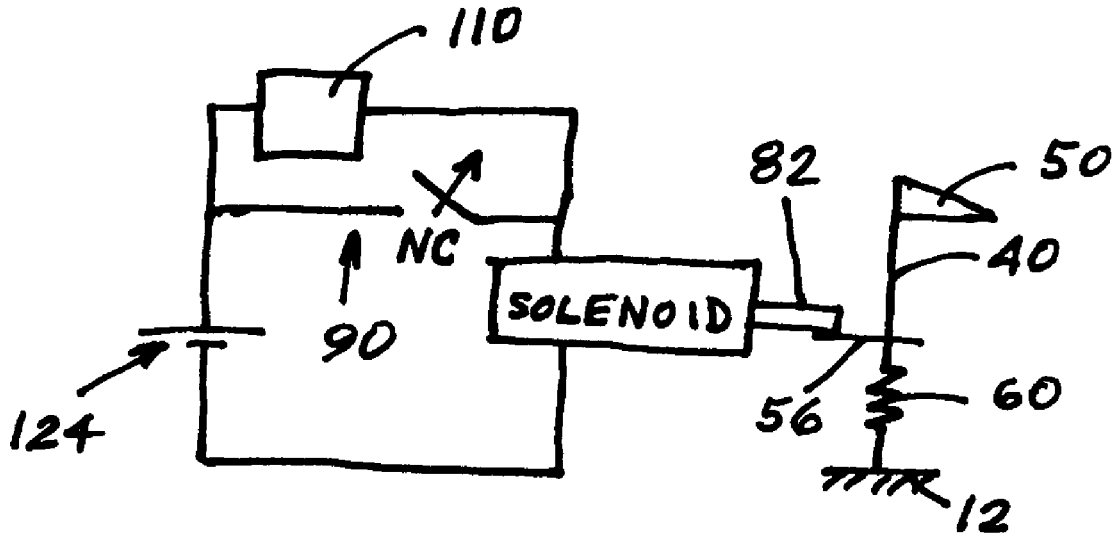
FIG. 3A shows a simple electric circuit used to control the signal flag.
Figure 3B:
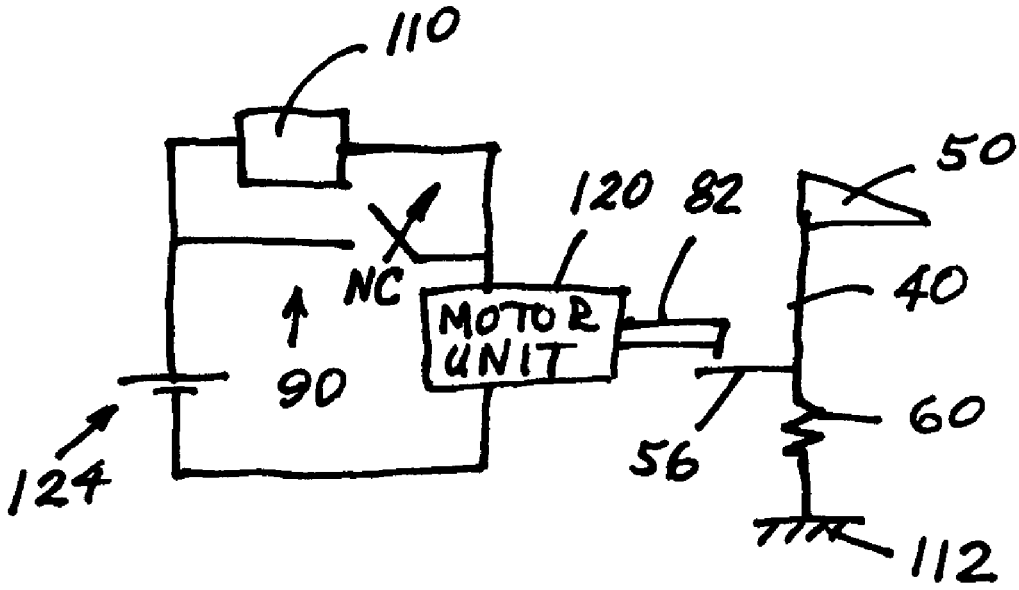
FIG. 3B shows an alternative electric circuit used to control the signal flag.

It is also noted that the solenoid unit 80 can be replaced by a motor unit 120 shown in FIG. 3B. Operation of the motor unit 120 is similar to operation of the solenoid unit 80 and thus will not be discussed in detail. Both the solenoid 80 and the motor unit 120 can be powered from a battery 124 such as will be found on most water craft, or can include a battery that is contained in the signaling system.

Figure 4B:
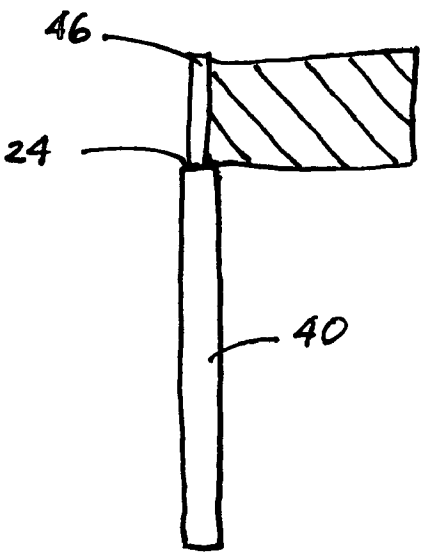
FIG. 4B shows the signal flag unit in a deployed condition.
Figure 4A:
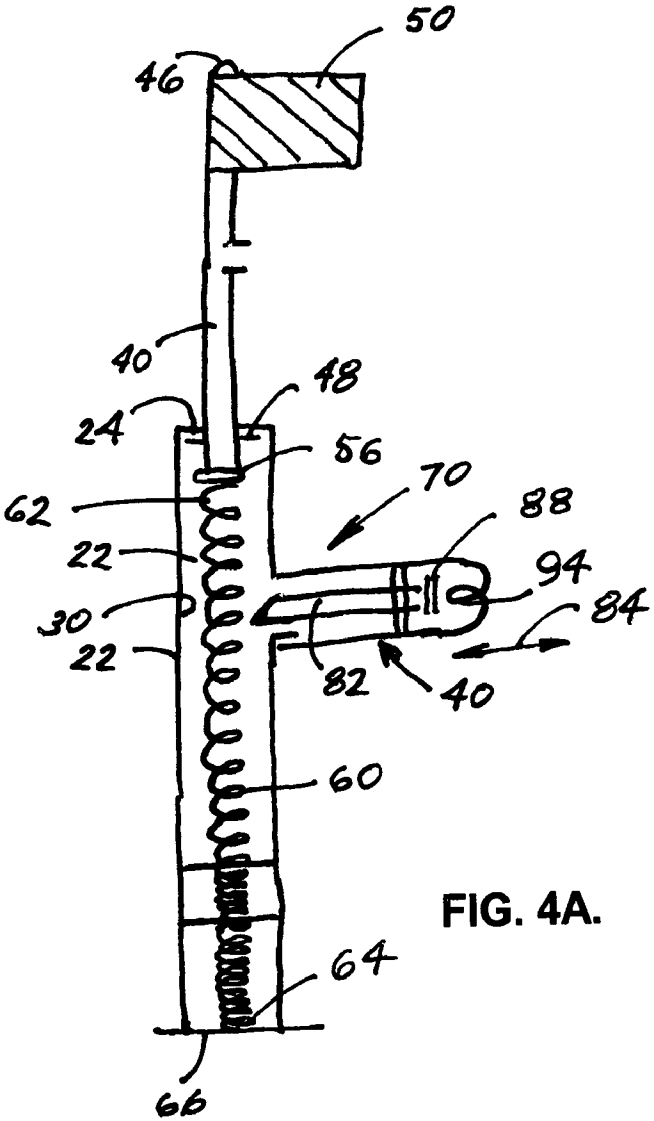
FIG. 4A shows the signal flag unit in a stored condition.
Figure 2:
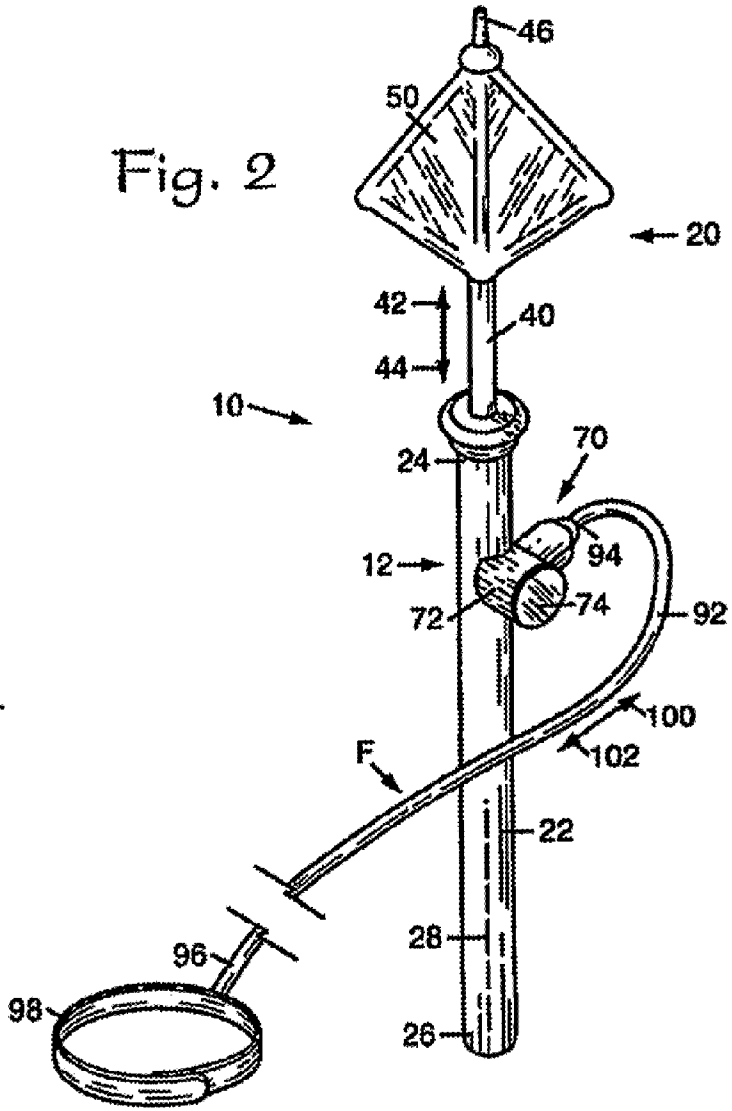
Figure 1:
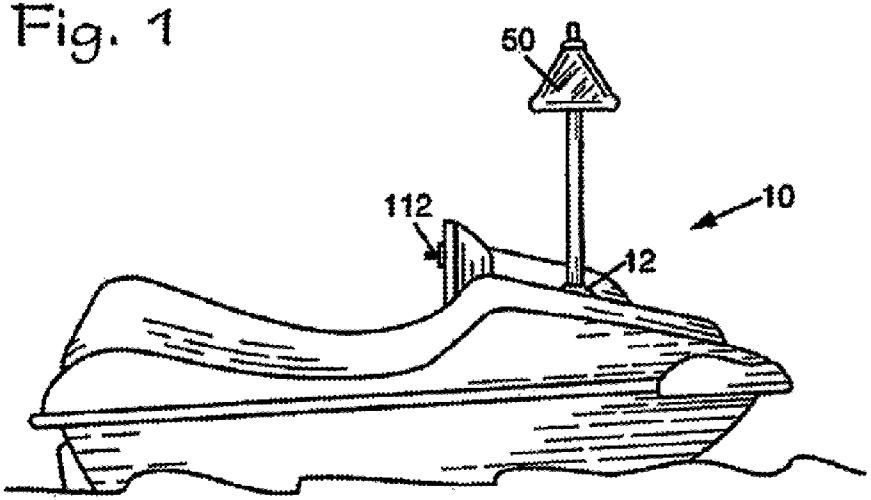
Figure 3B:
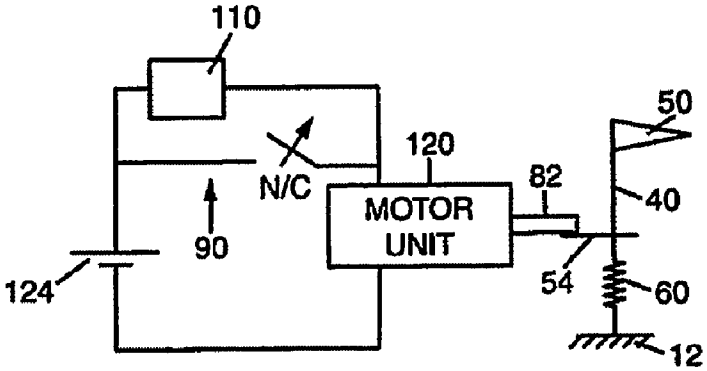
Figure 3A:
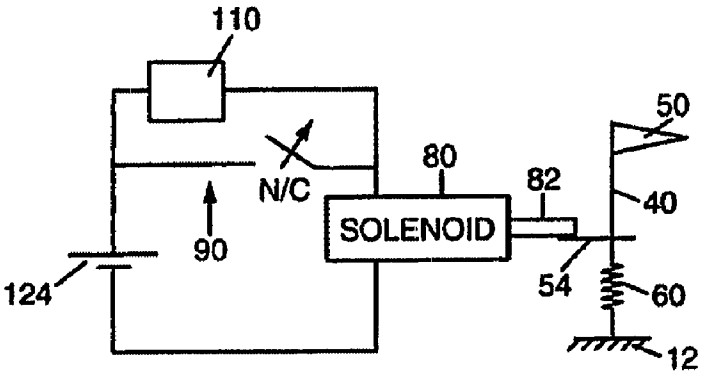
Figure 4B:
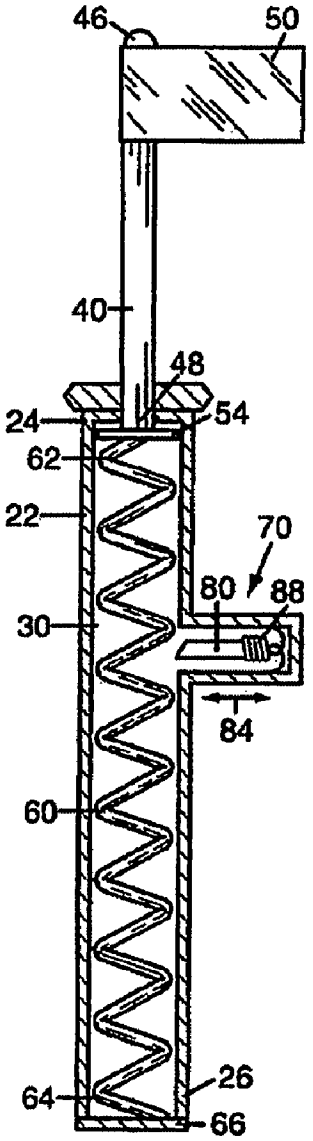
Figure 4A:
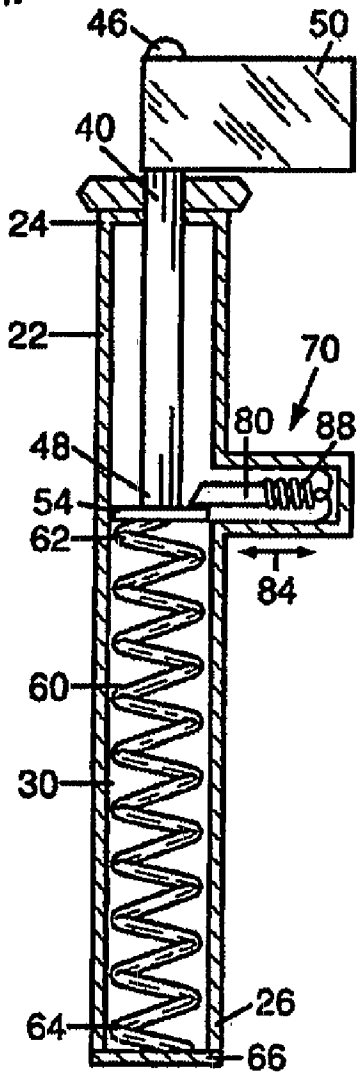

The circuits shown in FIGS. 3A and 3B show a switch N/C which is normally closed and will be opened when the cord 92 is pulled so the solenoid 80 or motor 120 is de-activated and the prong 82 is quickly removed from the blocking position shown in FIGS. 3A and 3B to permit the spring 60 to move the flag 20 from the FIG. 4A position to the FIG. 4B position.

It is understood that while certain forms of the present invention have been illustrated and described herein, it is not to be limited to the specific forms or arrangements of parts described and shown.

What is claimed and desired to be covered by Letters Patent is:

1. A water craft safety signal system comprising:

a) a mounting element mounted on a water craft;

b) a signal flag unit mounted in said mounting element and including (1) tubular housing having a first end which is a top end when said signal flag unit is mounted on the water craft, a second end which is a bottom end when said signal flag unit is mounted on the water craft, a longitudinal axis which extends between the first end and the second end of the tubular housing, a longitudinal bore which extends between the first end and the second end of the tubular housing, (2) a support staff slidingly accommodated in the bore of the tubular housing to move toward and away from the first end of the tubular housing, the support staff having a first end which is a top end when said signal flag unit is mounted on the water craft and which is positioned outside of the bore of the tubular housing, a second end which is a bottom end when said signal flag unit is mounted on the water craft and which is located inside the bore of the tubular housing, the support staff being movable within the tubular housing to move between a stored position with the first end of the support staff located near the first end of the tubular housing and a signaling position with the first end of the support staff spaced away from the stored position in the direction of the longitudinal axis of the tubular housing, (3) a signal element fixedly mounted on the support staff near the first end of the support staff, (4) a spring seat fixed to the second end of the support staff, and (5) a spring located in the bore of the tubular housing and having a first end engaged with the spring seat and a second end engaged with the tubular housing, the spring being arranged to bias the support staff out of the bore of the tubular housing toward the signaling position when the support staff is in the stored position; and c) a signal flag unit control system which includes (1) a retainer unit mounted on the tubular housing and including (A) a housing mounted on the tubular housing adjacent to the first end of the tubular housing, (B) a solenoid unit located in the housing of the retainer unit and having a solenoid controlled prong that extends into the bore of the tubular housing and moves toward and away from the spring seat in a direction transverse to the longitudinal axis of the tubular housing between a locked position engaging the spring seat and a release position spaced apart from the spring seat, the solenoid unit being located with respect to the spring seat so the prong engages the spring seat when the solenoid unit is in the release position when the support staff is in the stored position thereof to retain the support staff against movement toward the signaling position under the influence of the bias of the spring, the solenoid unit having the prong in the locked position when activated and moving the prong to the release position when de-activated, (2) a solenoid unit control unit which is connected to the solenoid unit to move the prong of the solenoid unit between the locked position and the release position and which includes (A) a cord having one end connected to the solenoid and a free end, (B) an ankle strap on the free end of the cord, (C) the cord moving between a first position and a second position, with the solenoid being de-activated when the cord is in the second position, and (D) a manual override system having a manual switch and being connected to the solenoid unit to activate or de-activate the solenoid unit using the manual switch of the manual override system.

2. The water craft safety signal system as described in claim 1 further including a quick-disconnect element on the cord.

3. A water craft safety signal system comprising:

a) a mounting element mounted on a water craft;

b) a signal flag unit mounted in said mounting element and including (1) tubular housing having a first end which is a top end when said signal flag unit is mounted on the water craft, a second end which is a bottom end when said signal flag unit is mounted on the water craft, a longitudinal axis which extends between the first end and the second end of the tubular housing, a longitudinal bore which extends between the first end and the second end of the tubular housing, and (2) a support staff slidingly accommodated in the bore of the tubular housing to move toward and away from the first end of the tubular housing, the support staff having a first end which is a top end when said signal flag unit is mounted on the water craft and which is positioned outside of the bore of the tubular housing, a second end which is a bottom end when said signal flag unit is mounted on the water craft and which is located inside the bore of the tubular housing, the support staff being movable within the tubular housing to move between a stored position with the first end of the support staff located adjacent to the first end of the tubular housing and a signaling position with the first end of the support staff spaced away from the stored position in the direction of the longitudinal axis of the tubular housing, (3) a signal element fixedly mounted on the support staff near the first end of the support staff, (4) a spring seat fixed to the second end of the support staff, and (5) a spring located in the bore of the tubular housing and having a first end engaged with the spring seat and a second end engaged with the tubular housing, the spring being arranged to bias the support staff out of the bore of the tubular housing toward the signaling position when the support staff is in the stored position; and c) a signal flag unit control system which includes (1) a retainer unit mounted on the tubular housing and including (A) a housing mounted on the tubular housing adjacent to the first end of the tubular housing, (B) a motor unit located in the housing of the retainer unit and having a motor controlled prong that extends into the bore of the tubular housing and moves toward and away from the spring seat in a direction transverse to the longitudinal axis of the tubular housing between a locked position engaging the spring seat and a release position spaced apart from the spring seat, the motor unit being located with respect to the spring seat so the prong engages the spring seat when the motor unit is in the release position when the support staff is in the stored position thereof to retain the support staff against movement toward the signaling position under the influence of the bias of the spring, the motor unit having the prong in the locked position when activated and moving the prong to the release position when de-activated, and (2) a motor unit control unit which is connected to the motor unit to move the prong of the motor unit between the locked position and the release position and which includes (A) a cord having one end connected to the motor and a free end, (B) an ankle strap on the free end of the cord, (C) the cord moving between a first position and a second position, with the motor being de-activated when the cord is in the second position, and (D) a manual override system having a manual switch and being connected to the motor unit to activate or de-activate the motor unit using the manual switch of the manual override system.

* * * * *

UNITED STATES PATENT AND TRADEMARK OFFICE

CERTIFICATE OF CORRECTION

PATENT NO. : 7,059,264 B1
APPLICATION NO. : 11/116545
DATED : June 13, 2006
INVENTOR(S) : Michael W. Hall et al.

It is certified that error appears in the above-identified patent and that said Letters Patent is hereby corrected as shown below:

The title page should be deleted and substitute therefore the attached title page.

Figure 1:
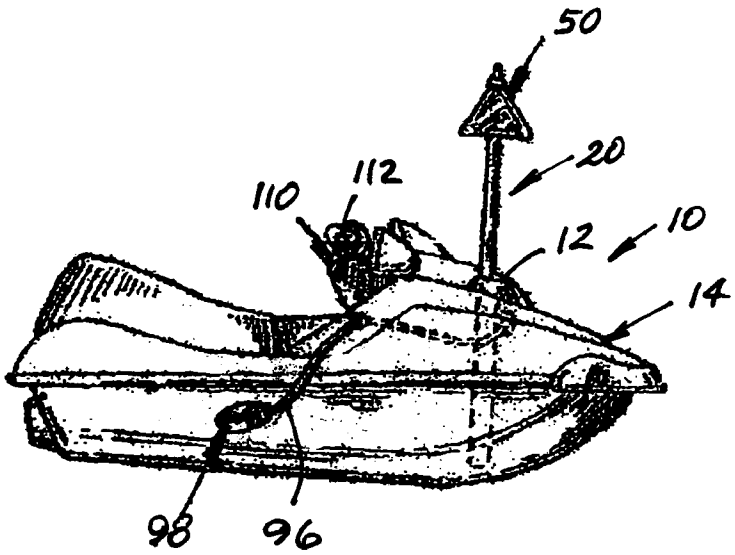
FIG. 1 is a side view of a water craft embodying the present invention.

Drawings:
Delete drawing sheets 1-3, and substitute therefor the drawing sheets, consisting of Figs. 1-3, as shown on the attached pages.

Signed and Sealed this

Nineteenth Day of December, 2006

JON W. DUDAS
*Director of the United States Patent and Trademark Office*

(12) United States Patent
Hall et al.

(10) Patent No.: US 7,059,264 B1
(45) Date of Patent: Jun. 13, 2006

(54) WATER CRAFT SAFETY SIGNAL SYSTEM

(76) Inventors: Michael W. Hall, 14193 Remington Ct., Fontana, CA (US) 92336; Donna K. Hall, 14193 Remington Ct., Fontana, CA (US) 92336

( * ) Notice: Subject to any disclaimer, the term of this patent is extended or adjusted under 35 U.S.C. 154(b) by 0 days.

(21) Appl. No.: 11/116,545

(22) Filed: Apr. 29, 2005

(51) Int. Cl.
*B63B 17/00* (2006.01)

(52) U.S. Cl. ..... 114/343; 116/173

(58) Field of Classification Search ..... 114/253, 114/343; 116/28 R, 173; 840/984
See application file for complete search history.

(56) References Cited

U.S. PATENT DOCUMENTS

| | | | | |
|---|---|---|---|---|
| 3,117,549 | A * | 1/1964 | Ripepe | 116/28 R |
| D235,094 | S | 5/1975 | Murphy et al | |
| 4,099,282 | A | 7/1978 | Townsend | |
| 4,483,683 | A | 11/1984 | Alley, Sr. | |
| 4,624,141 | A | 11/1986 | Soleau | |
| 4,689,611 | A | 8/1987 | Franklin | |
| D296,476 | S | 6/1988 | Kline et al. | |
| 4,934,972 | A * | 6/1990 | Shumway et al. | 114/253 |
| 4,962,720 | A * | 10/1990 | Leffel | 116/173 |
| 4,977,849 | A * | 12/1990 | Brinton | 116/28 R |
| 5,024,179 | A * | 6/1991 | Leffel | 116/173 |

* cited by examiner

*Primary Examiner*—Lars A. Olson
(74) *Attorney, Agent, or Firm*—Donald R. Schoonover

(57) ABSTRACT

A safety system includes a signal flag that is mounted on a water craft and which is connected to a person in a manner such that should the person fall into the water, the signal flag will be automatically and immediately deployed whereby any watercraft in the vicinity will be alerted to the presence of a person in the water.

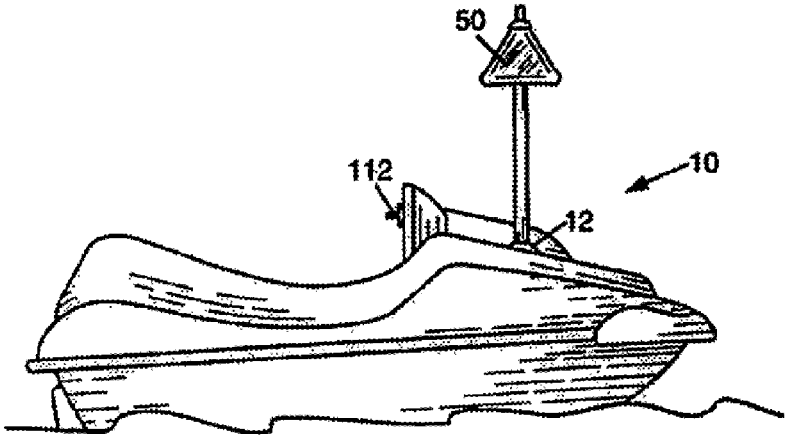

3 Claims, 3 Drawing Sheets